US006307941B1

(12) United States Patent
Tanner, Jr. et al.

(10) Patent No.: US 6,307,941 B1
(45) Date of Patent: Oct. 23, 2001

(54) SYSTEM AND METHOD FOR LOCALIZATION OF VIRTUAL SOUND

(75) Inventors: Theodore Calhoun Tanner, Jr., Menlo Park; James Patrick Lester, III, Los Gatos, both of CA (US)

(73) Assignee: Desper Products, Inc., Mountain View, CA (US)

( * ) Notice: Subject to any disclaimer, the term of this patent is extended or adjusted under 35 U.S.C. 154(b) by 0 days.

(21) Appl. No.: 08/892,649

(22) Filed: Jul. 15, 1997

(51) Int. Cl.[7] ..... H04R 5/00
(52) U.S. Cl. ..... 381/17; 381/1; 381/309
(58) Field of Search ..... 381/1, 17, 63; 387/18, 309, 310, 19

(56) References Cited

U.S. PATENT DOCUMENTS

| | | | | |
|---|---|---|---|---|
| 4,118,599 | | 10/1978 | Iwahara et al. | 179/1 G |
| 4,910,779 | | 3/1990 | Cooper et al. | 318/26 |
| 4,975,954 | | 12/1990 | Cooper et al. | 381/26 |
| 5,034,983 | | 7/1991 | Cooper et al. | 381/25 |
| 5,136,651 | | 8/1992 | Cooper et al. | 381/25 |
| 5,173,944 | | 12/1992 | Begault | 381/17 |
| 5,333,200 | | 7/1994 | Cooper et al. | 381/1 |
| 5,371,799 | | 12/1994 | Lowe et al. | 381/25 |
| 5,381,482 | | 1/1995 | Matsumoto et al. | 381/18 |
| 5,412,731 | * | 5/1995 | Desper | 381/1 |
| 5,420,929 | * | 5/1995 | Geddes et al. | 381/1 |
| 5,438,623 | | 8/1995 | Begault | 381/17 |
| 5,440,638 | * | 8/1995 | Lowe et al. | 381/1 |
| 5,440,639 | | 8/1995 | Suzuki et al. | 381/17 |
| 5,459,790 | | 10/1995 | Scofield et al. | 381/25 |
| 5,495,534 | * | 2/1996 | Inanaga et al. | 381/310 |
| 5,495,576 | | 2/1996 | Ritchey | 395/125 |
| 5,500,900 | | 3/1996 | Chen et al. | 381/17 |
| 5,521,981 | | 5/1996 | Gehring | 381/17 |
| 5,544,249 | | 8/1996 | Opitz | 381/63 |
| 5,557,227 | | 9/1996 | Cook et al. | 327/346 |
| 5,572,591 | | 11/1996 | Numazu et al. | 381/1 |
| 5,579,396 | * | 11/1996 | Iida et al. | 381/1 |
| 5,596,644 | | 1/1997 | Abel et al. | 381/17 |
| 5,598,478 | | 1/1997 | Tanaka et al. | 381/17 |
| 5,622,172 | | 4/1997 | Li et al. | 128/661.1 |
| 5,659,619 | | 8/1997 | Abel | 381/17 |
| 5,661,812 | | 8/1997 | Scofield et al. | 381/25 |
| 5,684,881 | | 11/1997 | Serikawa et al. | 381/86 |
| 5,714,997 | | 2/1998 | Anderson | 348/39 |
| 5,729,612 | | 3/1998 | Abel et al. | 381/56 |
| 5,742,689 | | 4/1998 | Tucker et al. | 381/17 |

FOREIGN PATENT DOCUMENTS

| | | | |
|---|---|---|---|
| WO95/31881 | 11/1995 | (WO) | H04S/5/00 |

OTHER PUBLICATIONS

J. O. Smith III, "Techniques for Digital Filter Design and System Identification With Application to the Violin," CCRMA, Dept. of Music, Report No. STAN–M–14, Stanford University, Jun. 1983.

W. Gardner, "Immersive Audio Using Loudspeakers," Thesis Proposal for the degree of Doctor of Philosophy at MIT, Mar., 1996.

M. Morimoto et al., "Effects of Low Frequency Components on Auditory Spaciousness," Acustica, vol. 66 (1988), pp. 190–196.

(List continued on next page.)

*Primary Examiner*—Xu Mei
(74) *Attorney, Agent, or Firm*—Wilson Sonsini Goodrich & Rosati; Michael J. Murphy

(57) ABSTRACT

A system and method for providing improved virtual sound images. One or more spatial cues of an audio signal may be modulated within a described range to increase the clarity and perceived localization of a virtual sound image. Interaural time delay, interaural intensity difference and/or spectra may be varied at below the "just noticeable level" to cause the virtual source location to move slightly relative to the listener's head. Such variation assists the listener's auditory system in filtering out ambiguous spatial cue information from the audio signal. The resulting virtual sound image has a larger sweet spot and is less sensitive to head movement.

24 Claims, 13 Drawing Sheets

OTHER PUBLICATIONS

D. Griesinger, "Multichannel Matrix Surround Decoders for Two–Eared Listeners," AES 101st Convention, Los Angeles, CA, Nov. 8–11, 1996.

T. Takala et al., "An Integrated System for Virtual Audio Reality," AES 100th Convention, Copenhagen, May 11–14, 1996.

M. Yanagida et al., "Application of the least–squares method to sound–image localization in multi–loudspeaker multi–listener case," J. Acoust. Soc. Jpn. (E)4, 2 (1983).

Y. Haneda et al., "Common acoustical poles independent of sound directions and modeling of head–related transfer functions," J. Acoust. Soc. Jpn. (E) 15, 4 (1994).

K. Abe et al., "A method for simulating the HRTF's considering head movement of listeners," J. Acoust. Soc. Jpn. (E) 15, 2 (1994).

D. Furlong et al., "Interactive Virtual Acoustics Synthesis System for Architectural Acoustics Design," AES 93rd Convention, San Francisco, CA Oct. 1–4, 1992.

D. J. Furlong et al., "Spaciousness Enhancement of Stereo Reproduction using Spectral Stereo Techniques," AES 89th Convention, Los Angeles, CA Sep. 21–25, 1990.

C. J. MacCabe et al., "Virtual Imaging Capabilities of Surround Sound Systems," AES 93rd Convention, San Francisco, CA, Oct. 1–4, 1992.

J. Jot et al., "Digital Signal Processing Issues in the Context of Binaural and Transaural Stereophony," AES 98th Convention, Paris, Feb. 25–28, 1995.

K. Iida et al., "Some further consideration on auralization of a sound field based on a binaural signal processing model," J. Acoust. Soc. Jpn. (E) 16, 2 (1995).

M. Gerzon, "Psychoacoustic Decoders for Multispeaker Stereo and Surround Sound," AES 93rd Convention, San Francisco, CA, Oct. 1–4, 1992.

C. J. McCabe et al., "Special Stereo Surround Sound Pan–Pot," AES 90th Convention, Paris, Feb. 19–22, 1991.

K. Inanaga et al., "Headphone System with Out–of–Head Localisation Applying Dynamic HRFT (Head Related Transfer Function)," AES 98th Convention, Paris, Feb. 25–28, 1995.

P. U. Svensson et al., "Subjective performance of some time–varying methods for acoustic feedback control," submitted to the Journal of the Acoustical Society of America, Nov. 1994.

J. Huopaniemi et al., "Review of Digital Filter Design and Implementation Methods for 3–D Sound," AES 102nd Convention, Munich, Germany, Mar. 22–25, 1997.

D. Griesinger, "Dolby Surround Decoding—Present and Future," AES 91st Convention, New York, Oct. 4–8, 1991.

W. Bray et al., "Head acoustics Binaural Mixing Console and AACHENHEAD Recording System: Tools for 3D Sound Production," AES 91st Convention, New York, Oct. 4–8, 1991.

L. Feldman, "SRS: Surround Sound With Only Two Speakers," AES 91st Convention, New York, Oct. 4–8, 1991.

R. Predovich, "IMAX® Sound Production of Multi–Channel Sound for Large Screen Cinema," AES 91st Convention, New York, Oct. 4–8, 1991.

D. Clark et al., "Results of 1990 AES Surround Sound Decoder Workshop," AES 91st Convention, New York, Oct. 4–8, 1991.

D. Lowe et al., "System for Development of QSound's 3D Sound Placement Filters From Empirical Data," AES 91st Convention, New York, Oct. 4–8, 1991.

C. Chan, "Sound Localization and Spatial Enhancement Realization of the Roland Sound Space Processor," AES 91st Convention, New York, Oct. 4–8, 1991.

D. Gray, "Practical Aspects of Dolby Surround," AES 91st Convention, New York, Oct. 4–8, 1991.

W. Woszczyk, "'ES'—Direct Microphone Encoder for Surround Sound Recording," AES 91st Convention, New York, Oct. 4–8, 1991.

S. Craig, "Dolby Stereo—A Mixing Perspective," AES 91st Convention, New York, Oct. 4–8, 1991.

* cited by examiner

SYSTEM AND METHOD FOR LOCALIZATION OF VIRTUAL SOUND

FIELD OF THE INVENTION

The field of present invention relates generally to virtual acoustics and binaural audio. More particularly, the field of the present invention relates to a virtual sound system and method for simulating spatially localized "virtual" sound sources from a limited number of actual speakers.

BACKGROUND

Over the past twenty years, considerable progress has been made in the field of virtual acoustics and binaural audio. Researchers in the field have advanced the understanding of psychoacoustics by developing sound systems that can generate virtual sound sources—perceived sound sources that appear to the listener to originate in areas of space that are distinct from the actual physical location of the speakers.

It is well understood in the field of virtual acoustics that a listener's localization of a sound source is largely a function of the difference of the sound wave fronts at each of the ears of the listener. Interaural time difference (ITD) refers to the delay in time, and interaural intensity difference (IID) refers to the attenuation in intensity, between "sound" perceived at the left and right ear drums of the listener. The brain uses these differences in the timing and magnitude of sounds between the ears to localize and identify the position in space from which the sound originates.

At frequency differences between the left and right ear below about 1.5 kHz (i.e., frequencies where the wavelength is larger than the listener's head), a listener determines the position in space from which a sound originates based primarily on the difference in time at which the sound reaches (i.e., the ITD) the left and right ears of the listener. However, at frequency differences higher than about 1.5 kHz, the spatial cue provided by the ITD is generally not sufficient for a listener to determine the location solely based on the ITD difference.

Instead, at frequencies greater than approximately 500 Hz and less than 10 kHz, a listener may depend primarily on intensity differences in the sound received by the left and right ears of the listener (i.e., the IID). Variations in intensity levels between the left and right eardrums are interpreted by the human auditory system as changes in the spatial position of the perceived sound source relative to the listener. Thus, a virtual sound system can create a virtual or "3-D " sound affect by providing a listener with appropriate spatial cues (ITD, IID) for the desired location of the virtual sound image.

However, in order to provide realistic and accurate virtual sound image, the sound system must also take into account the shape of the listener's head and the pinnae (or outer ear drum) of each ear of the listener. The pinnae for each ear imposes unique frequencydependent amplitude and time differences on an incoming signal for a given source position. The term Head-Related Transfer Functions (HRTF) is used to describe the frequencydependent amplitude and time-delay differences in perceived sound originating from a particular sound source that results from the complex shaping of the pinnae at the left and right ear drums of the listener. Thus, an effective virtual sound system provides ITD and IID spatial cues that have been modified to compensate for the spectral alterations of the HRTF of the listener.

Several technical barriers exist to providing realistic virtual audio over conventional speakers. The sound heard at each ear of the listener is a mixture of signals from all of the speakers providing sound to the listener. This mixture of signals or "crosstalk" makes it very difficult to create a stable virtual sound image because of the enormous complexity involved in calculating how the different signals will mix at a listener's ear. For example, in a two-speaker system, sound signals from each of the two speakers will be heard by both ears and mix in an unpredictable manner to alter the spectral balance, ITD and IID differences in sound signals perceived by the listener.

A theoretical solution for this dilemma, known as crosstalk cancellation, was originally proposed over 20 years ago. Crosstalk cancellation presupposes that a sound system can add a binaural signal at each speaker that is the inverse (i.e., 180 degrees out of phase) of the crosstalk coming from a competing speaker, delayed by the difference in it takes the competing speakers sound to reach the opposite ear, to cancel the sound of the undesired speaker at a given ear. Thus, using crosstalk cancellation, a sound system can, in theory, assure that a listener's left ear hears the output of the left speaker and a listener's right ear hears the output of the right speaker.

While systems have been implemented using crosstalk cancellation, several limitations have been encountered in conventional systems. In particular, the virtual effect may be restricted to a relatively small area at a specific distance and angle from the speakers. Outside this "sweet spot," the quality of the virtual sound effect may be greatly diminished. As a result, the number of listeners that may experience the virtual image at a time is limited. In addition, the virtual effect may be restricted to a narrow range of head positions within the "sweet spot," so a listener may lose the virtual sound effect entirely by turning his head. Such systems require the listener to remain in a fixed position relative to the speakers and, consequently, are impractical for many commercial applications.

Such limitations make conventional crosstalk cancellation difficult to implement in practice. Effective crosstalk cancellation typically requires precise knowledge of the location of the speakers, location of each listener and the head position of each listener. Deviations by the listeners from the expected physical location and head position relative to the speakers may result in a large and sudden attenuation of the virtual effect.

Some systems have attempted to compensate for the above limitations by limiting crosstalk cancellation to a particular band of frequencies. For example, crosstalk cancellation may be limited to signals having frequencies between approximately 600 Hz to 10 kHz, an approximation of the frequency range over which the human auditory system can localize a sound source based primarily on the IID. This limitation of frequencies at which crosstalk is canceled increases the range of head movement that can occur within the predetermined sweet spot.

What is needed is an improved system and method for localizing sound in a virtual system. Preferably such a system and method would provide a larger sweet spot and be less sensitive to head movement of listeners in the sweet spot. In addition, such a system and method would preferably enhance the listeners' ability to perceive and differentiate the location of virtual sources.

SUMMARY OF THE INVENTION

One aspect of the present invention provides a system and method for providing improved virtual sound images. One or more spatial cues of an audio signal may be modulated within a desired range to increase the clarity and perceived localization of the virtual sound image. Such modulation may be used to cause the virtual source location to move slightly relative to the listener's head. Preferably, such movement is not consciously perceived by the listener.

It is an advantage of this and other aspects of the present invention that virtual sound images may be provided to multiple listeners located within an enlarged sweet spot, with less sensitivity to the actual head position of the listeners. The modulation in the spatial cue(s) of an audio signal and resulting unperceived "movement" of the virtual source is believed to assist the auditory system in filtering out ambiguous ITD, IID, and/or spectra spatial cues.

Another aspect of the present invention provides for a system and method for spatially shifting the perceived virtual source location of an audio signal. A spatial shift signal may be applied to an audio signal to modify one or more spatial cues (such as ITD, IID, spectra, or any combination thereof) to approximate the value of the spatial cues that would be produced if the audio signal were actually output from the location of the virtual source. The spatial shift signal may be modulated prior to modifying the audio signal to enhance perceived localization as described above. Alternatively, one or more spatial cues of the audio signal may be modulated directly after the audio signal is modified by the spatial shift signal.

Another aspect of the present invention provides a system and method for canceling crosstalk among a set of spatially shifted audio signals. A delayed, inverted signal may be produced to cancel a crosstalk signal. The delay applied to one or more of the signals may be modulated within a desired range to enhance the perceived localization of the virtual sound image as described above. The ITD of the signal may be effectively modulated in this manner.

Another aspect of the present invention provides a system and method for providing a more robust virtual sound image. A plurality of audio signals may be modified to have one or more spatial cues (such as ITD, IID, spectra, or any combination thereof) to approximate those that would be produced if the audio signals were actually output from the location of one or more virtual sources. Crosstalk among the audio signals may be canceled. The resulting audio signals may then be enhanced to increase the depth of the sound perceived by the listener. It is an advantage of this and other aspects of the present invention that a more robust virtual sound image representing multiple virtual sources may be produced without noticeable crosstalk interference.

BRIEF DESCRIPTION OF THE DRAWINGS

These and other features and advantages of the present invention will become more apparent to those skilled in the art from the following detailed description in conjunction with the appended drawings in which.

DESCRIPTION

Figure 1:
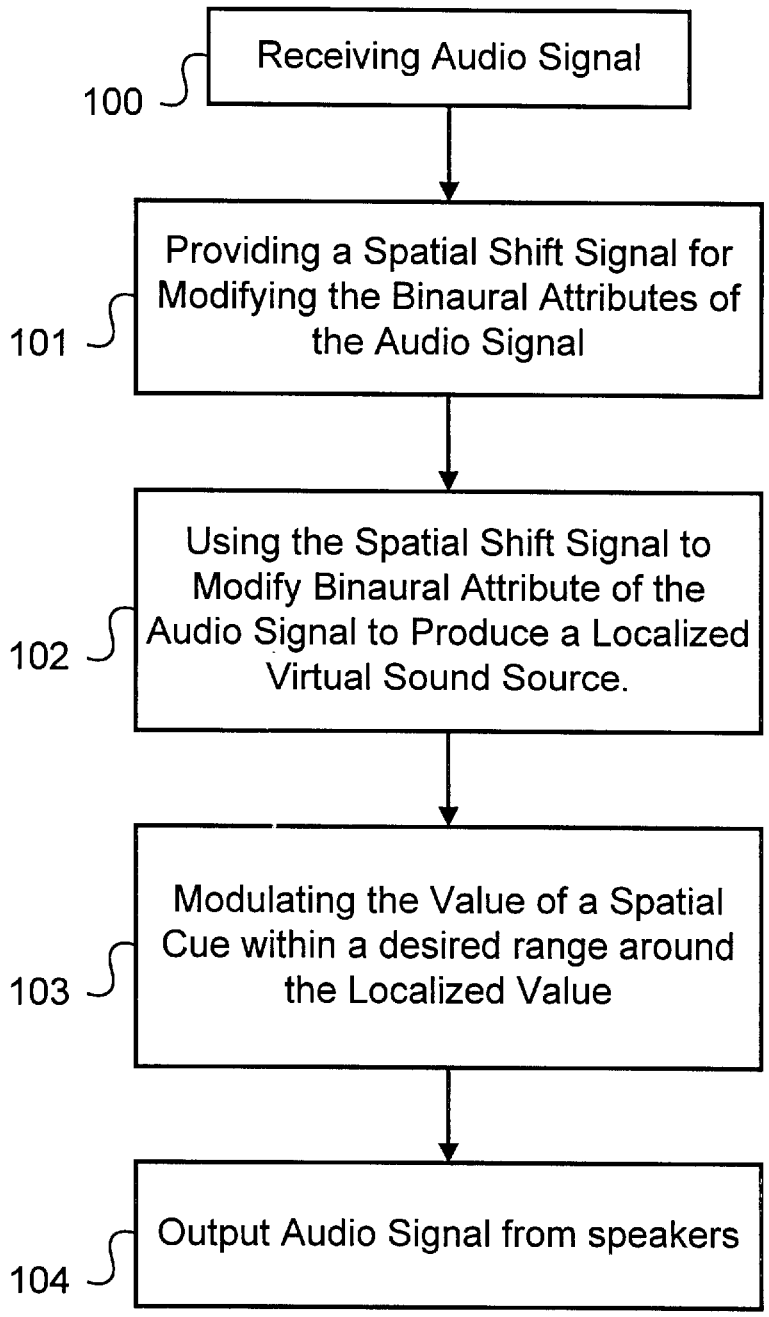
FIG. 1 is a flow chart illustrating a process for generating multiple virtual sound images that are localized in space relative to the listener in accordance with an exemplary embodiment of the present invention.

FIG. 1 is a simplified flow chart that is illustrative of an embodiment of the present invention. In step 100, at least one audio input signal is received by the virtual sound system. This audio input signal may be any typical analog or digital audio input signal. In step 101, the virtual sound system retrieves a spatial shift signal that is associated with the desired location (relative to the speakers and listeners of the virtual sound system) of the virtual sound source. The spatial shift signal may be a set of coefficients or a continuous signal or other values that may be applied to an audio signal to modify one or more spatial cues of the audio signal. For instance, the spatial shift signal may represent a time delay to modify ITD, an amplitude shift to modify IID, or a magnitude by which to shift the spectra to modify the spectral attributes of the audio signal. In the exemplary embodiment, the spatial shift signal comprises the direction specific impulse response ("DSIR") associated with the desired location of the virtual sound source. The DSIR comprises the coefficient values (for the left and right ears of listeners) used by an exemplary embodiment of the present invention to modify at least one spatial cue of the audio input signal in order to produce the desired binaural attribute of the virtual sound source. While the DSIR preferably comprises coefficients from complex HRTFs that take into account the ITD, IID and spectral shift of an audio signal, any variety of spatial shift signals may be used to modify the binaural attributes of the audio signal.

In step 102, the virtual sound system uses the DSIR to modify the binaural attribute of the audio input signal. As shown below, the modification of the binaural attribute of the audio input signal, may be performed by an HRTF Binaural Synthesis System. One of the results of step 102 is a pair of "binaural" output signals, one for each ear, for each audio input signal that is associated with a specific virtual source location. The term ipsilateral is used to designate the signal associated with the ear closer to the sound source and the term contralateral is used to designate the signal that associated with the ear that is further from the virtual source location. These "binaural pair" of signals possess the spatial cues for the left and right ears of the listener. Together, the binaural pair of signals will produce the binaural attribute of the virtual sound source. The applicable DSIR coefficients may be applied to one or both of the ipsilateral and contralateral signals to spatially shift the virtual sound image that will be produced. For instance, the DSIR (or other spatial shift signal) may cause one signal to be delayed, and/or its intensity to be increased or decreased, and/or its spectra to be modified relative to the other signal to change the perceived location of the virtual source. The spatial shift signal may include delay values (which may represent, for instance, the number of clock cycles to delay one signal) or intensity or spectral shift values (which may be multiplied or added to the signal to change its intensity or spectra).

In step 103, the localization and integrity of the virtual sound source perceived by a listener is improved by modulating the value of at least one of the spatial cues within at least one of the binaural pair of output signals created in step 102. The term modulating or modulation refers to varying a value (e.g., a spatial cue) within a desired range at a specified rate. The spatial shift signal itself may be modulated prior to being applied to the audio signal(s) or the spatial cues of the audio signal(s) may be modulated directly (e.g., by applying a varying delay to the signal).

In the exemplary embodiment of FIG. 1, the modulation of the spatial cue has the effect of continuously "moving" the position of the virtual sound source relative to the head of a listener (or, in other words, "varying" the head position of the listener relative to the position of the virtual sound source). Studies have shown that (i) the position of moving sound sources is better localized by listeners than the position of static sound sources and (ii) a listener who is allowed to vary his or her head position during the localization process can more accurately localize the position of a sound source than a listener whose head position remains fixed during localization. This is because the changes in ITD, IID and spectra that occur with either (i) sound source movement or (ii) head movement assist the auditory system in filtering out ambiguous ITD, IID and/or spectra spatial cues.

However, in the exemplary embodiment shown in FIG. 1, modulation of a spatial cue would be undesirable if it altered the perceived location of the virtual sound source or the tonal quality of the virtual sound. Neither effect occurs in the exemplary embodiment. The perceived location of the virtual sound source remains "fixed" because (1) the values of the spatial cue are modulated about the desired spatial cue value so that the average position is at the desired value and (2) the magnitude (i.e., range) of changes in the spatial cue are set to a level below the "just noticeable difference" ("jnd") level for the modulated spatial cue. The jnd of a spatial cue is the magnitude of change below which the human auditory system does not consciously perceive a difference in the nature of sound being heard. Thus, a listener's ability to localize a virtual source may be improved by changing ITD, IID or spectra spatial cues without causing associated changes in perceived pitch or tone.

Moreover, because the virtual source is always, in effect, moving relative to the head position of the listener, the exemplary embodiment of the present invention is less sensitive to the head movement of listeners. The spatial cue changes that would be associated with normal head movement are subsumed within the modulation of the spatial cues by the system of the exemplary embodiment.

Finally, the "sweet spot" of the exemplary embodiment of FIG. 1 is enlarged over typical conventional virtual sound systems which are dependent on a listener being at a specified position relative to the speakers (i.e., at a position with a predetermined set of spatial cues). The "moving" nature of the virtual sound source increases the area over which the virtual sound effect can be perceived and allows a listener to gradually enter and exit the effect. With conventional "static" virtual sound systems, the listener often experiences an abrupt drop off of the virtual effect when the listener moves from the specific sweet spot and head position.

Figure 2:
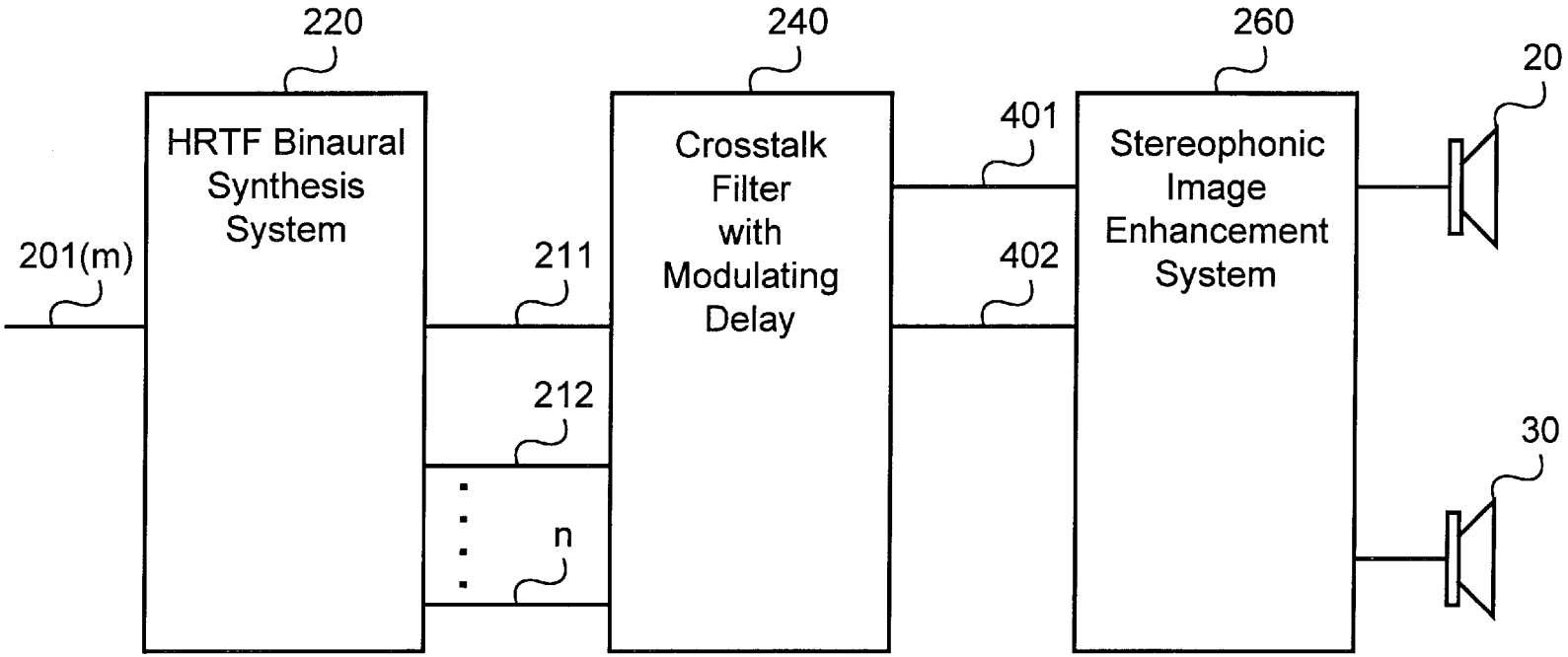
FIG. 2 is a block diagram of a virtual sound system according to an exemplary embodiment of the present invention for generating multiple virtual sound images that are localized in space relative to the listener.

FIG. 2 is a simplified block diagram of virtual sound system according to an exemplary embodiment of the present invention. The virtual sound system includes HRTF Binaural Synthesis System 220, Crosstalk Filter With Modulating Delay 240, a Stereophonic Image Enhancement System 260 and speakers 20 and 30. HRTF Binaural Synthesis System 220 receives a plurality of audio input signals 201 and then proceeds to modify the binaural attribute of each audio input signal such that each audio input signal is transformed into a binaural pair of output signals that possess the binaural attribute of the desired virtual sound source. For example where the number of audio input signals equals two (2), the HRTF Binaural Synthesis System 220 provides the Crosstalk Filter With Modulating Delay 240 with two (2) binaural pair of signals 211 and 212. Each binaural pair of signals is comprised of two signals—the ipsilateral and contralateral signals. The Crosstalk Filter With Modulating Delay 240 performs a crosstalk cancellation operation on the binaural pair of signals 211 and 212. During this crosstalk cancellation the Crosstalk Filter With Modulating Delay 240 modulates the ITD of one or more of the signals such that at least one spatial cue is varied in a range and at a rate just below the jnd value for the spatial cue. Crosstalk Filter With Modulating Delay 240 then provides the Stereophonic Image Enhancement System 260 with an input signal associated with each speaker (20 or 30). Stereophonic Image Enhancement System 260 processes signals 401 and 402 to increase the "robustness" or depth of the virtual image. The output of Stereophonic Image Enhancement System 260 is sent to speakers 20 and 30.

Figure 3:
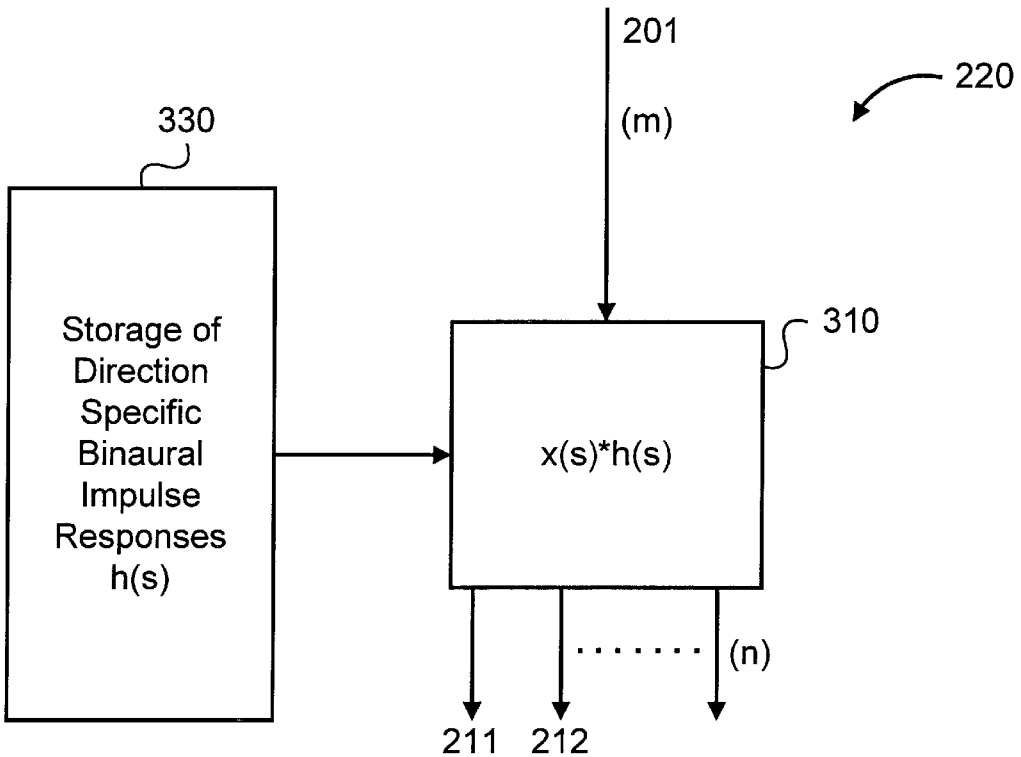
FIG. 3 is a block diagram showing in additional detail portions of block 300 of FIG. 2, this block being designated as the "HRTF Binaural Synthesis System" in FIG. 2.

FIG. 3 is simplified block diagram illustrating the HRTF Binaural Synthesis System 220 in further detail. Referring to FIG. 3, the HRTF Binaural Synthesis System includes a convolution engine 310 for modifying the binaural attributes of audio input signal 201 and memory 330 for the storage of the spatial shift signals (e.g., the direction specific binaural impulse responses) for the left and right ears. The convolution engine 310 multiplies the spectra of each of the input signals 201 with the spectra of the appropriate direction specific binaural impulse response stored in memory 330 to create the proper binaural pair of output signals associated with a particular virtual source. For example, if the number of audio input signals is equal to two (2), the HRTF Binaural Synthesis System will produce two (2) binaural pairs of signals, 211 and 212. Each binaural pair of output signals possesses the proper binaural attributes of the virtual sound source associated with a particular input signal. The convolution engine 310 provides functionality similar to one or more finite impulse response ("FIR") filters or infinite impulse response ("IIR") filters. A description of the use of convolution, digital filters and virtual sound may be found in "3-D Sound for Virtual Reality and Multimedia" by Durand R. Begault (1994), which is hereby incorporated herein by reference in its entirety.

There are many well-known types of HRTF binaural synthesis in the field of virtual acoustics and binaural audio. Exemplary embodiments may use, but are not limited to, any combination of (i) FIR and/or IIR filters (digital or analog) and (ii) spatial shift signals (e.g., coefficients) generated using any of the following methods:

raw impulse response acquisition;
balanced model reduction;
hankel norm modeling;
least square modeling;
modified or unmodified Prony methods;
minimum phase reconstruction;
Iterative Pre-filtering; or
Critical Band Smoothing.

For a further explanation of the above methods see J. Smith III, Ph.D. dissertation report (# Stan-M-14) entitled "Techniques for Digital Filter Design and System Identification with Application to the Violin" and in C. Lueck, Ph.D. dissertation report (Iowa State University 1995) entitled "Modeling of Head Related Transfer Functions for Reduced Computation and Storage," each of which is hereby incorporated herein by reference in its entirety.

Figure 4A:
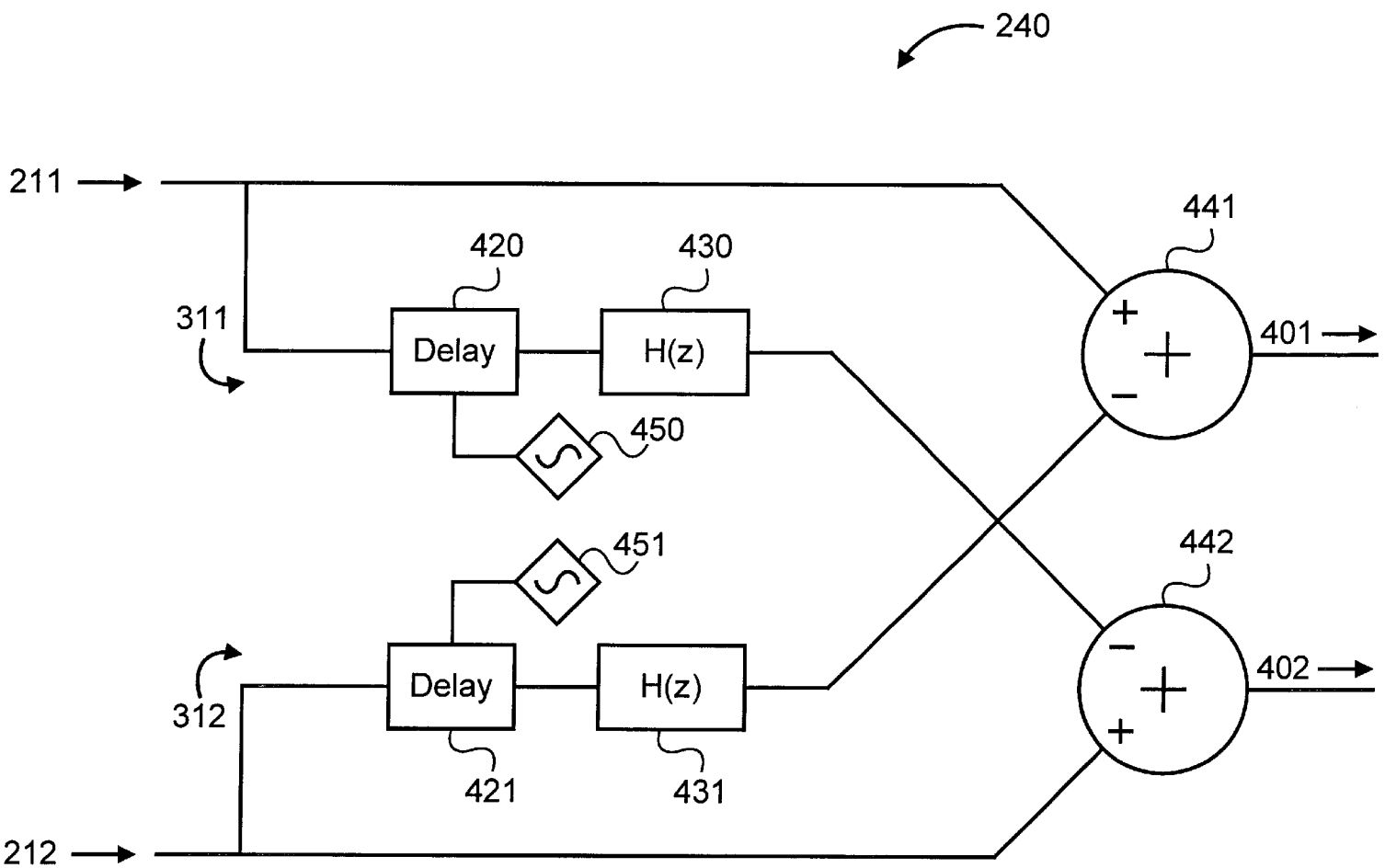
FIG. 4A is a block diagram showing in additional detail portions of one embodiment of block 400 of FIG. 2, this block being designated as "Crosstalk Filter With Modulating Delay."

FIG. 4A is a simplified block diagram illustrating the operation of the Crosstalk Filter With Modulating Delay 240 that performs the crosstalk operation on the binaural pair signals 211 and 212. However, in this embodiment, the crosstalk operation is only performed on the ipsilateral signal of each binaural pair. The contralateral signals of binaural pairs 211 and 212 are ignored by the crosstalk filter (i.e., grounded) because the contralateral signal is often negligible for common speaker-based configurations. In blocks 420 and 421, a delay is imposed on the crosstalk compensation signals 311 and 312 to compensate for the time it takes an undesired crosstalk signal to reach the opposite ear of the listener where such signal 211 or 212 is to be canceled. The delays in blocks 420 and 421 are modulated by modulators 450 and 451 such that the ITD delays imposed on the crosstalk compensation signals 311 and 312 are modulated between approximately 0.09 msec and 2.25 msec at a modulation rate of between about 0.5 and 1.5 Hz in the time or frequency domain. The modulation rate of between about 0.5 and 1.5 Hz approximates the listener slightly turning his head back and forth at a rate of between about once every 2 seconds and once every ⅔ second. After passing through delay blocks 420 and 421, crosstalk compensation signals 311 and 312 pass through lowpass filters 430 and 431 which cutoff a portion of the signal above a set frequency. Typically, the cut off frequency for the low pass filter is set at approximately 8 kHz. It has been found that the best crosstalk cancellation effect occurs if the gain for lowpass filters 430 and 431 is set at about ½ the power of the signal to be canceled. The crosstalk compensation signals 311 and 312 and signals 211 and 212 are then summed together as shown at junction 441 and 442 and sent to the speakers as signals 401 and 402 either directly or after any subsequent audio enhancement or processing.

Figure 4B:
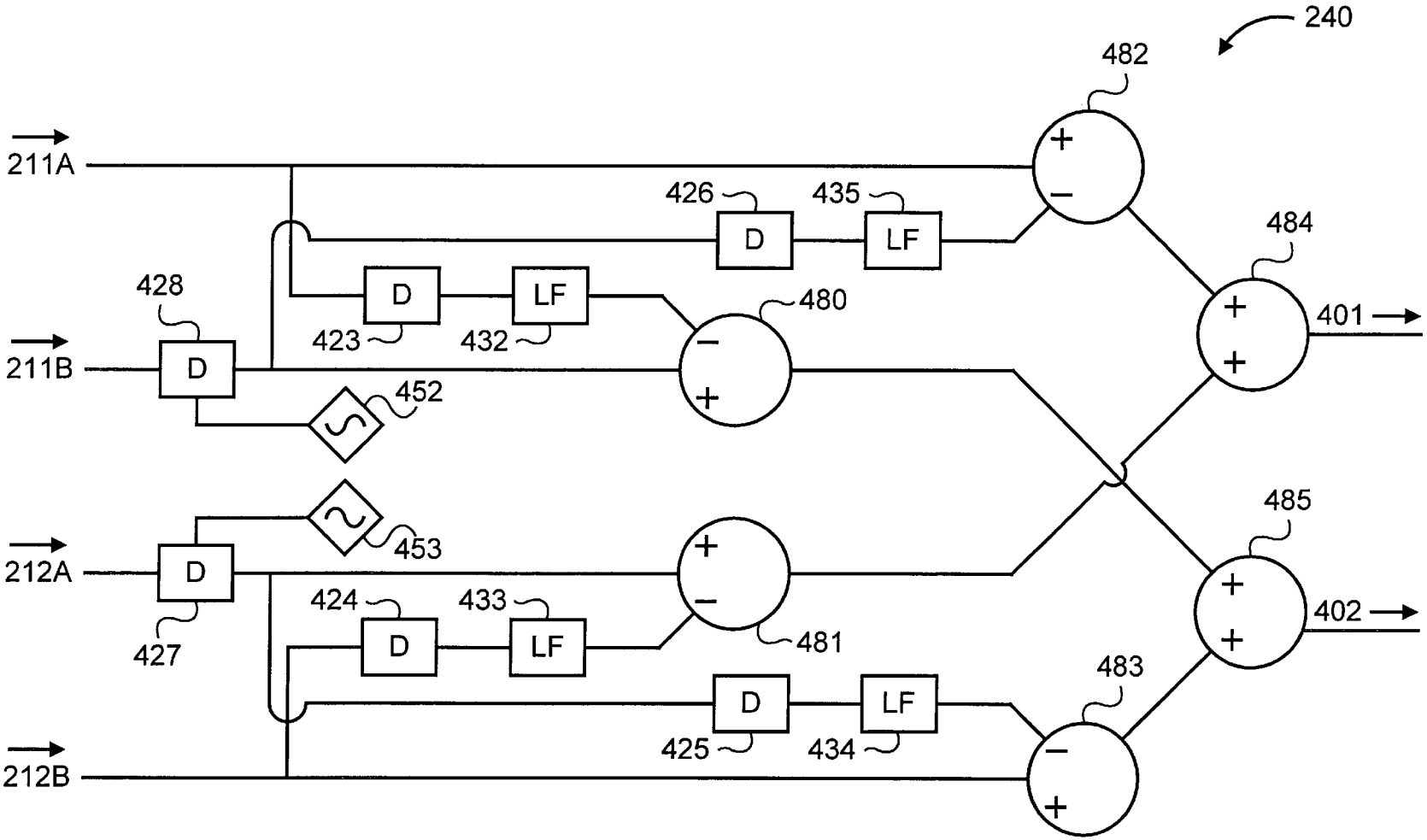
FIG. 4B is a block diagram showing in additional detail portions of a second embodiment of block 400 of FIG. 2, this block being designated as "Crosstalk Filter With Modulating Delay."

FIG. 4B is a simplified block diagram illustrating the operation of another exemplary embodiment of the Crosstalk Filter With Modulating Delay 240 that performs the crosstalk operation on both the ipsilateral and contralateral signals of binaural pairs 211 and 212. In this embodiment, processed contralateral signals 211B, 212A and ipsilateral signals 211A, 212B are crosstalk canceled separately before finally being summed together at junctions 484 and 485 and output as signals 401 and 402.

Signal 211A is the ipsilateral signal intended to be output from speaker signal 401 (which may be output, for instance, from the left speaker). Signal 211B is the corresponding contralateral signal intended to be output from speaker signal 402 (which may be output, for instance, from the right speaker). The contralateral signal is delayed by block 426 (to account for propagation delay of the corresponding crosstalk produced by the contralateral signal from the right speaker) and passed through low pass filter 435. It is then inverted at stage 482 and combined with ipsilateral signal 211A. The inverted signal is thereby provided to the left speaker to cancel any corresponding crosstalk produced by the contralateral signal from the right speaker.

Additional signals are also sent to the left speaker in the system of FIG. 4B. These signals include (i) the contralateral signal 212A from the other (e.g., right) binaural pair and (ii) the delayed inverse of the ipsilateral signal 212B from the right binaural pair (to cancel crosstalk). Ipsilateral signal 212B is delayed by block 424 (to account for propagation delay of the corresponding crosstalk produced by the ipsilateral signal from the right speaker) and passed through low pass filter 433. It is then inverted at stage 481 and combined with contralateral signal 212A before being sent to the left speaker.

The signals to be sent to the left speaker are summed together at stage 484 to produce speaker signal 401. As described above, these signals include: (i) the ipsilateral signal 211A from the left binaural pair and the contralateral signal 212A from the right binaural pair; and (ii) delayed, inverted signals to cancel crosstalk from the contralateral signal 211B from the left binaural pair and the ipsilateral signal 212B from the right binaural pair.

Similar processing is used to produce speaker signal 402 for the right speaker. The signals to be sent to the right speaker are summed together at stage 485 to produce speaker signal 402. These signals include: (i) the ipsilateral signal 212B from the right binaural pair and the contralateral signal 211B from the left binaural pair; and (ii) delayed, inverted signals to cancel crosstalk from the contralateral signal 212A from the right binaural pair and the ipsilateral signal 211A from the left binaural pair.

In addition to the foregoing, in the embodiment of FIG. 4B, delay stages 428 and 427 are applied to contralateral signals 211B and 212A respectively. The delays imposed by these stages are modulated by modulators 452 and 453 respectively. These delay stages and modulators vary the ITD attribute of the audio signal in a manner similar to delay stages 420 and 421 and modulators 450 and 451 described above with reference to FIG. 4A. As described above, the ITD may be modulated between approximately 0.09 msec and 2.25 msec at a modulation rate of between about 0.5 and 1.5 Hz in the time or frequency domain. Preferably, the ITD is varied in a manner that has the effect of slightly moving the virtual source location relative to the listener's head to enhance the ability of the listener to localize the virtual source. As described above, however, such "movement" preferably is not consciously perceived by the listener.

Delay blocks 423, 424, 425, 426, 427 and 428 represent time delays. For example, in a digital system, a delay block may be represented mathematically as: x(s-d), where x is the signal at a given sample, s is the current sample and d is the number of samples of delay. Modulators 452 and 453 operate at frequencies of between about 0.5 Hz and 1.5 Hz. Modulation may be accomplished in either the time or frequency domains, and by any number of modulation signals, not limited to sine, triangle, square, sawtooth, or random waveforms. The modulation function need not be periodic. The desired effect could be achieved by generating random values around the desired spatial cue value. It has been found that a periodic triangle waveform provides a preferred localization effect for listeners.

Figure 5A:
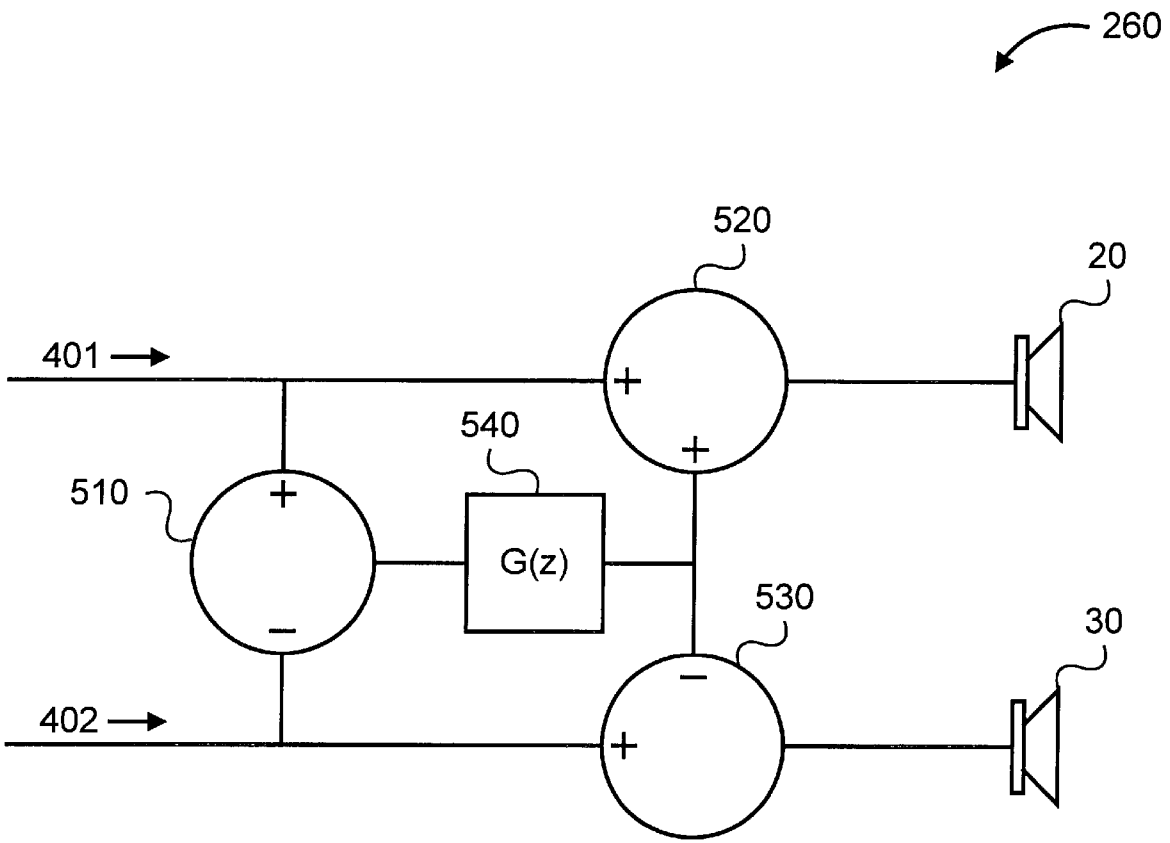
FIG. 5A is a block diagram showing in additional detail portions of block 260 of FIG. 2, this block being designated as the "Stereophonic Image Enhancement System" in FIG. 2.
Figure 5B:
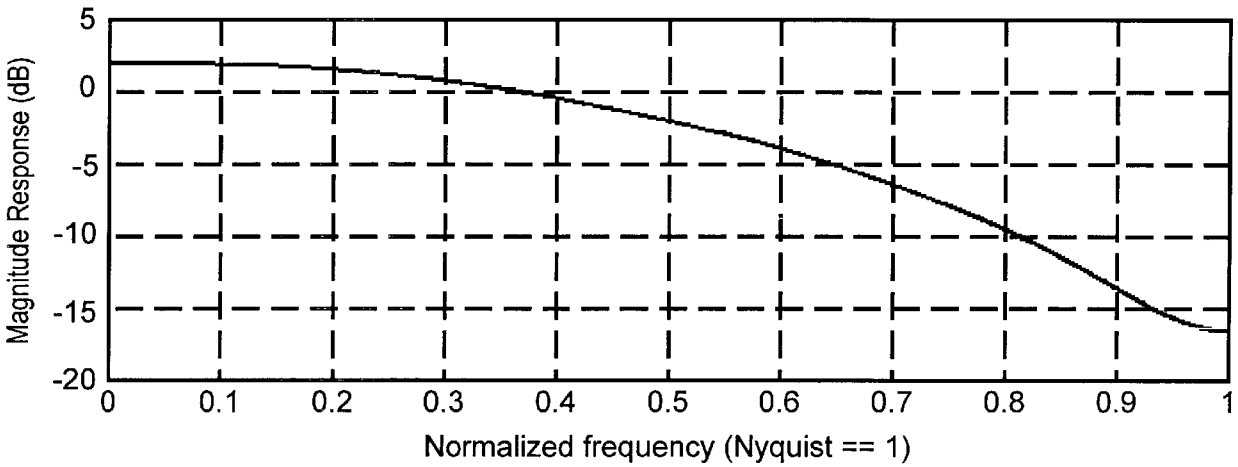
FIG. 5B is a chart showing the magnitude response of an exemplary embodiment of filter 540 of FIG. 5A.
Figure 5C:
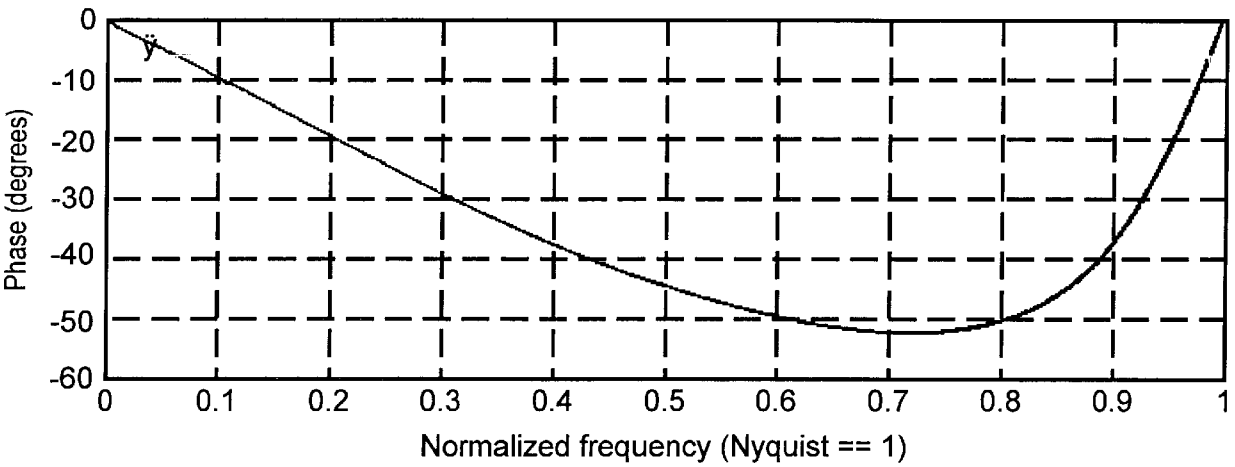
FIG. 5C is a chart showing the phase response of an exemplary embodiment of filter 540 of FIG. 5A.

FIG. 5A illustrates the stereophonic image enhancement system shown as block 260 of FIG. 2 in additional detail. This stereophonic image enhancement system is similar in effect to the automatic stereophonic image enhancement system described and claimed in U.S. Pat. No. 5,412,731, which is incorporated herein by reference in its entirety. At junction 510, signal 401 is summed with the inverse of signal 402. The result of this summation is then passed through filter 540. Filter 540 is a low pass filter having the characteristics shown in FIGS. 5B (magnitude response) and 5C (phase response). At junction 520, signal 401 is summed with the output of filter 540 and sent to speaker 20. At junction 530, signal 402 is summed with the inverse of the output of filter 540 and sent to speaker 30. It has been found that connection of the stereophonic image enhancement system 260 to the output of the Crosstalk Filter With Modulating Delay 240 improves the quality of the virtual sound by increasing the depth of the sound perceived by the listener.

Figure 6A:
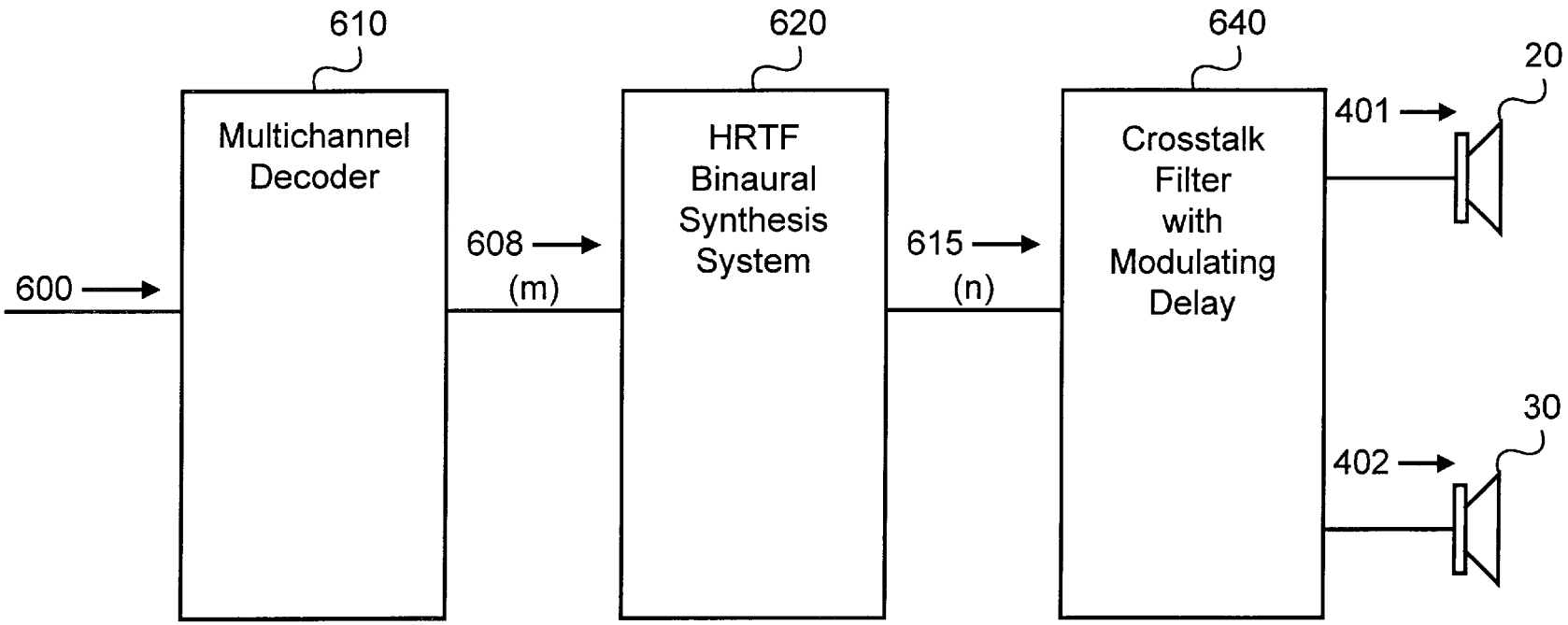
FIG. 6A is a block diagram of a multichannel virtual sound system according to an exemplary embodiment of the present invention.

FIG. 6A is a block diagram of a multichannel virtual sound system according to an exemplary embodiment of the present invention. Input audio signal 600 is decoded by multichannel decoder 610 into a plurality of channel signals 615. Multichannel decoder 610 may be any standard multichannel decoder including without limitation multichannel decoders such as Dolby AC-3, MPEG-2 and MPEG-3. These channel signals are then processed through an HRTF Binaural Synthesis System 620 which, except for the number of channel signals, may be identical to the HRTF Binaural Synthesis System 220 that is shown in FIGS. 2 and 3. The HRTF Binaural Synthesis System 620 provides each channel signal with the proper binaural attributes for its intended virtual spatial position. The plurality of output signals 615, which constitute a binaural pair of output signals for each channel signal from HRTF Binaural Synthesis System 620, are then processed through the Crosstalk Filter with Modulating Delay 640. For each binaural pair, Crosstalk Filter with Modulating Delay 640 may be identical to Crosstalk Filter With Modulating Delay 240.

Figure 6B:
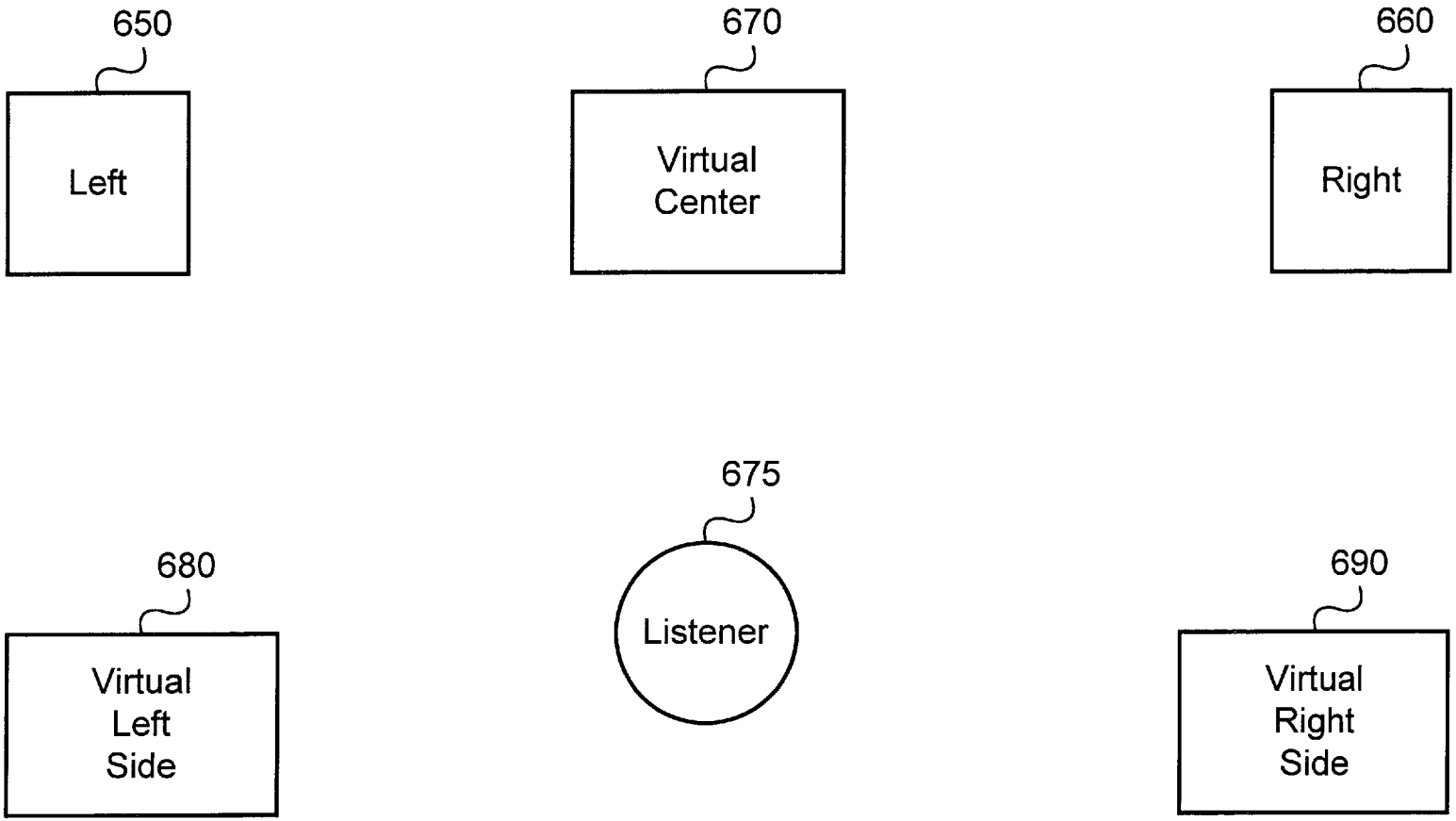
FIG. 6B shows the positions of the actual and virtual sources provided by an exemplary embodiment of the present invention.

FIG. 6B shows the positions of the actual and virtual sources which may be provided by an exemplary embodiment of the present invention. In such an embodiment, a surround sound effect may be produced from only two actual speakers, a left speaker 650 and a right speaker 660. In contrast to an actual surround sound system, which also uses center, left side and right side speakers, this embodiment uses a virtual center source 670, virtual left side source 680 and a virtual right side source 690. The virtual sources are simulated by providing spatially shifted audio signals from the left speaker 650 and right speaker 660.

Such an embodiment may be implemented as shown in FIG. 6A for example. An audio signal 600 with surround sound encoded information is processed by Multichannel Decoder 610. The Multichannel Decoder 610 may be a Dolby AC-3 decoder which produces a separate audio signal 608 for each surround sound speaker—a left, center, right, left side and right side audio signal. A low frequency signal may also be produced and, optionally, may be simulated in the same manner as the center speaker as described below.

In the exemplary embodiment, the various signals to be provided to the left speaker 650 and right speaker 660 are summed together. The left and right surround sound signals are passed directly to the left and right speakers respectively. The virtual center source 670 is simulated by reducing the center surround sound signal by approximately 3 decibels (i.e., dividing the signal by approximately the square root of 2). The reduced center surround sound signal is then passed to both the left speaker 650 and right speaker 660. Any optional low frequency surround sound signal may be virtualized in a similar manner.

The virtual left side source 680 and virtual right side source 690 are produced using an HRTF Binaural Synthesis System 220 and Crosstalk Filter with Modulating Delay 240 as described in conjunction with FIG. 2 above. With the configuration shown in FIG. 6B, the contralateral signals which would be produced by a left side source and right side sources would be insubstantial. Accordingly, only ipsilateral signals need to be processed as described above in conjunction with FIG. 4A. The resulting binaural signals (with crosstalk compensation signals) for the virtual left side source 680 and virtual right side source 690 are then provided to the left speaker 650 and right speaker 660 as applicable. The audio signals for the virtual left side 680 and virtual right side source 690 preferably have at least one modulated spatial cue to enhance the perceived localization of listener 675 as described above. While not consciously perceived, the slight variance in the virtual left side source 680 and the virtual right side source 690 improves localization relative to completely static virtual sources.

Once all of the signals for the left speaker 650 and right speaker 660 are summed together, they may be optionally passed through a Stereophonic Image Enhancement System 260 as described above with respect to FIGS. 2, 5A, 5B and 5C. The resulting signals provide a robust virtual sound effect with only two actual speakers.

Figure 7:
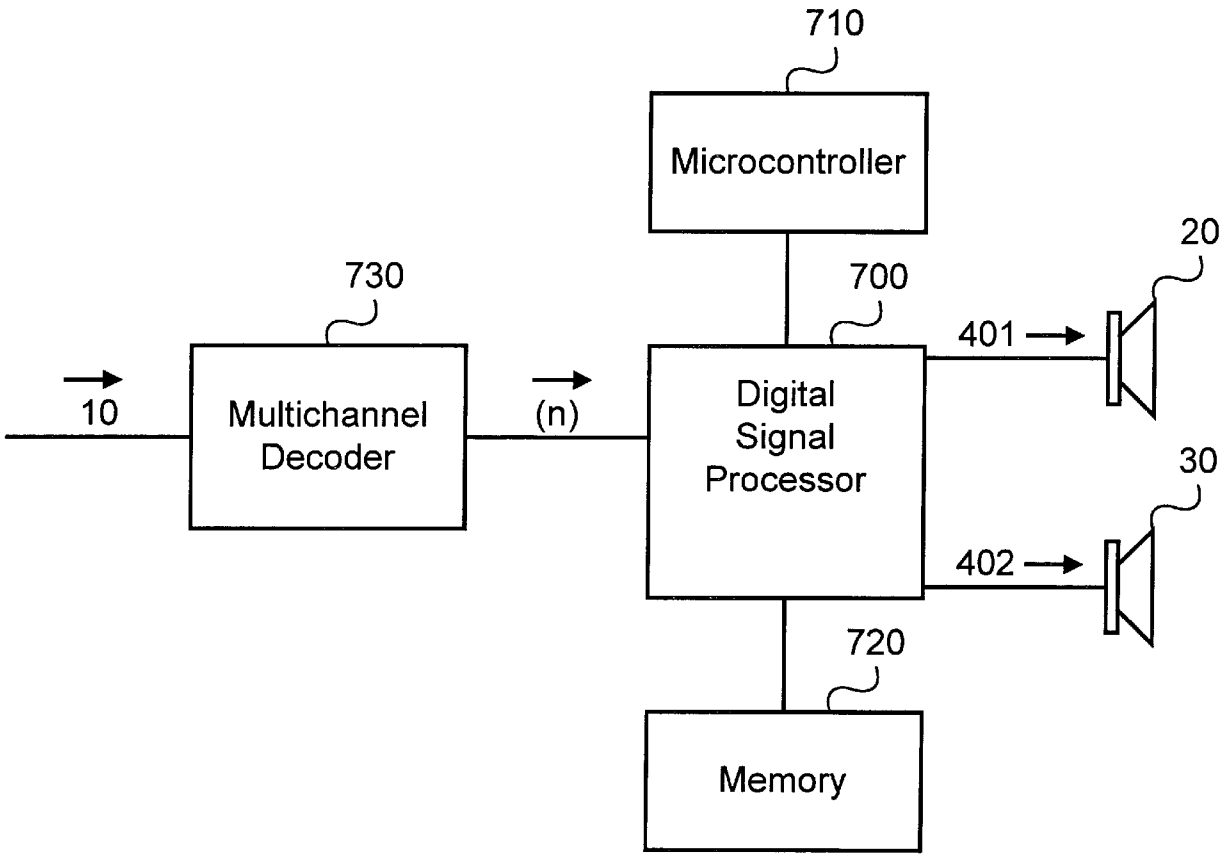
FIG. 7 is block diagram of a digital signal processor-based multichannel virtual sound system according to an exemplary embodiment of the present invention.

FIG. 7 is a simplified block diagram of a digital signal processor-based multichannel virtual sound system ("DSP System") that may be used to implement a variety of exemplary embodiments of the present invention. The DSP system includes a digital signal processor 700, microcontroller 710, memory 720, multichannel decoder 730 and speakers 20 and 30. Digital signal processor 700 may be any standard digital signal processor that is capable of performing the necessary calculations for real time processing of the incoming audio stream. Exemplary digital signal processors include without limitation Motorola 56000 series, Zoran 38000 series and Texas Instruments TMS 320 series. The digital signal processor 700 in the exemplary embodiment may perform, but is not limited to, the functions of a: (i) convolution engine and (ii) crosstalk filter with modulating delay. Additionally, in other embodiments, the digital signal processor may perform the functions of the multichannel decoder 730. Microcontroller 710 may be any standard microcontroller that may be used to respond to user requests and control the operation of the DSP system. Memory 720 may be any form of computer memory including without limitation ROM, EPROM, EEPROM and Flash EEPROM memory. Memory 720 should be sufficient for the storage of the spatial shift signals (e.g., direction specific binaural impulse responses) for the left and right ears. Speakers 20 and 30 may be any conventional speakers.

Figure 8:
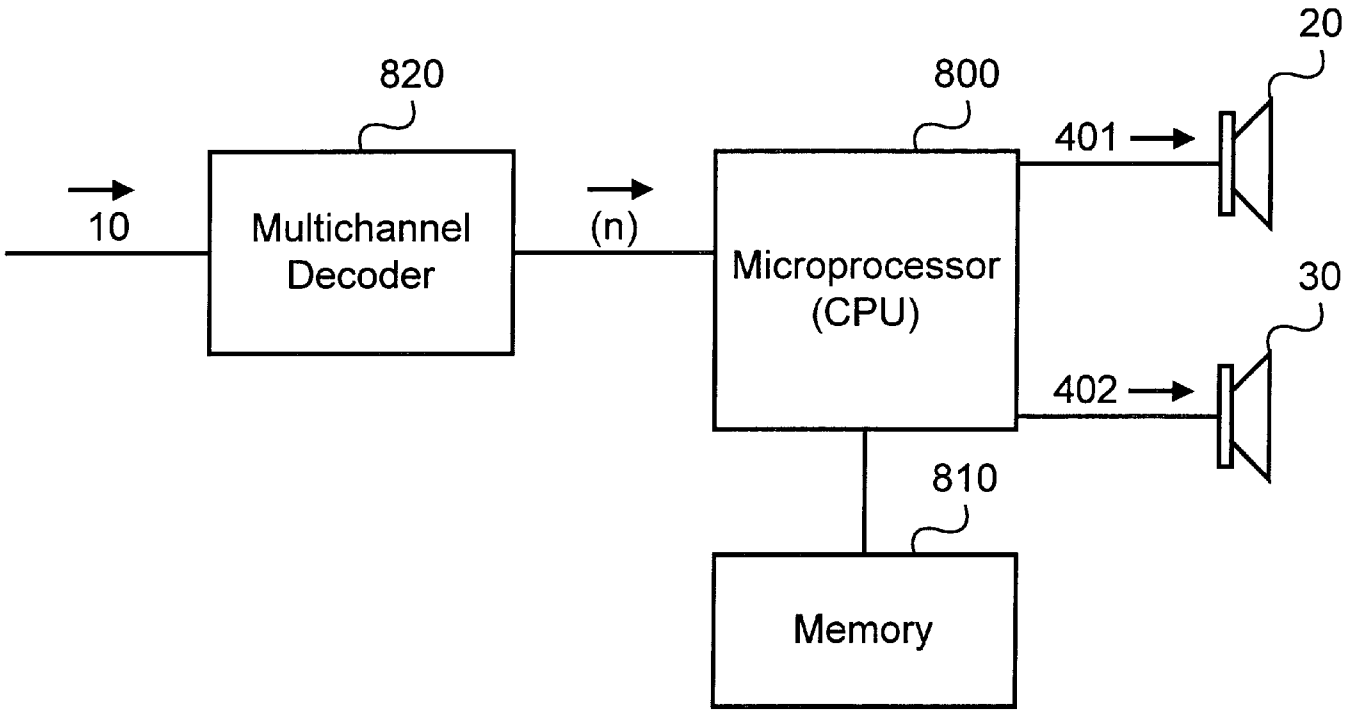
FIG. 8 is a block diagram of microprocessor-based multichannel virtual sound system according to an exemplary embodiment of the present invention.

FIG. 8 is a simplified block diagram of a microprocessor (or CPU) based multichannel virtual sound system ("CPU System") that may be used to implement a variety of exemplary embodiments of the present invention. The CPU system includes a microprocessor 800, memory 810, multichannel decoder 820 and speakers 20 and 30. Microprocessor 800 may be any standard microprocessor capable of performing the necessary calculations for real time processing of the incoming audio stream. Exemplary microprocessors include without limitation the Intel Pentium MMX, Intel Pentium II, Power PC and the DEC Alpha microprocessors. The microprocessor 800 in the exemplary embodiment may perform, but is not limited to, the functions of a: (i) convolution engine and (ii) crosstalk filter with modulating delay. Additionally, in some embodiments, the digital signal processor may perform all the functions of the multichannel decoder 820. Memory 820 may be any form of computer memory including without limitation ROM, PROM, EEPROM, Flash EEPROM memory, DRAM or SRAM. Memory 820 should be sufficient for the storage of the spatial shift signals (e.g., direction specific binaural impulse responses) for the left and right ears. Speakers 20 and 30 may be any conventional speakers.

Figure 9:
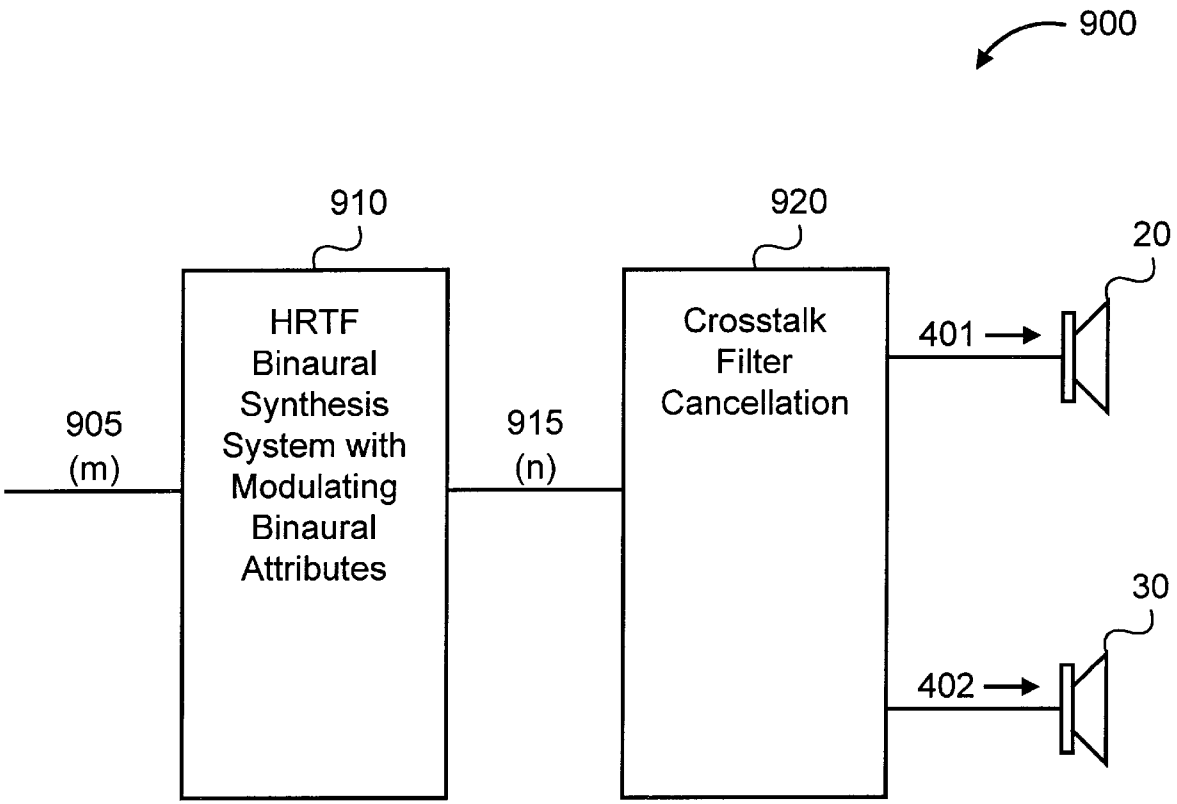
FIG. 9 is a simplified block diagram illustrating a virtual sound system according to an alternate embodiment of the present invention for generating multiple virtual sound images that are localized in space relative to the listener.

FIG. 9 is a simplified block diagram of a virtual sound system 900 according to an alternate embodiment of the present invention which generates localized virtual images by modulating a specific spatial cue in the HRTF Binaural Synthesis System 910. Referring to FIG. 9, audio input signals 905 are provided to HRTF Binaural Synthesis System 910. The HRTF Binaural Synthesis System 910 contains a spatial shift signal that is associated with the desired location (relative to the speakers and listeners of the virtual sound system) of the virtual sound source. In this embodiment, the spatial shift signal is the direction specific impulse response ("DSIR") for the desired location of the virtual sound source. The DSIR comprises the coefficient values (for the left and right ears of listeners) used by an exemplary embodiment of the present invention to modify at least one spatial cue of the audio input signals in order to produce the desired binaural attribute of the virtual sound source. The coefficient values may be, for instance, a time delay to modify the ITD binaural attributes of the audio input signals, an amplitude shift to modify the IID binaural attributes of the audio input signals, a magnitude by which to shift the spectra to modify the spectral attributes of the audio input signals, or a combination of the foregoing. The spatial shift signal may be used to modify the respective spatial cues of the audio signals to produce localized values for the spatial cues. The localized values for the spatial cues approximate values that would be produced if the audio signal were actually output from the desired location of the virtual source (i.e., at a certain offset from the actual speaker location).

In the embodiment of FIG. 9, however, a spatial shift signal for at least one of the spatial cues is modulated before being applied to the input audio signals. For instance, a spatial shift signal for IID or spectra shift (or the spatial cues in the audio signal itself) may be modulated between approximately 0.25 decibels and 1.5 decibels at a modulation rate of between about 0.5 and 1.5 Hz in the time or frequency domain. As described above, the spatial shift signal for ITD (or the spatial cue in the audio signal itself) may also be modulated between approximately 0.09 msec and 2.25 msec at a modulation rate of between about 0.5 and 1.5 Hz in the time or frequency domain. Any combination of the foregoing spatial cues may be modulated by modulating the spatial shift signal before applying it to the audio signal(s) or by modulating the spatial cues in the audio signal directly. Preferably, one or more of the spatial cues is varied in a manner that has the effect of slightly moving the virtual source location relative to the listener's head to enhance the ability of the listener to localize the virtual source. As described above, however, such "movement" preferably is not consciously perceived by the listener.

Figure 10:
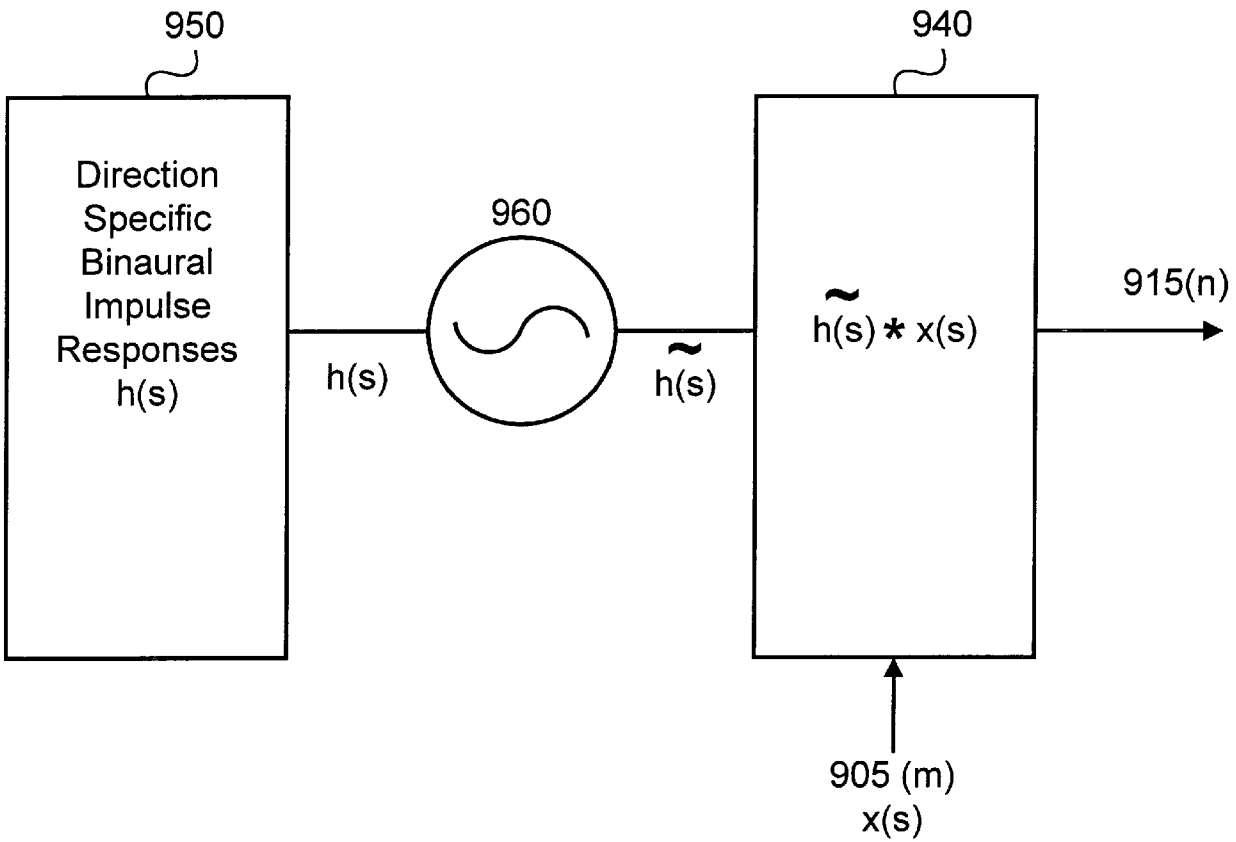
FIG. 10 is a block diagram showing in additional detail portions of block 700 of FIG. 9, this block being designated as "HRTF Binaural Synthesis System with Modulating Binaural Attributes."

FIG. 10 is a simplified block diagram illustrating the operation of HRTF Binaural Synthesis System With Modulating Binaural Attributes 910 in additional detail. As shown in FIG. 10, the HRTF Binaural Synthesis System With Modulating Binaural Attributes 910 includes a convolution engine 940, memory 950 for the storing the direction specific binaural impulse responses for the left and right ears and a modulator 960. The modulator 960 modulates the direction specific binaural impulse responses for one or more of the spatial cues as described above. After such modulation, the modulated direction specific binaural impulse responses are applied to the input audio signals 905 by convolution engine 940. The resulting signals 915 are modulated pairs of "binaural" output signals, one for each ear, for each audio input signal that is associated with a specific virtual source location. Except for the slight variance due to the modulation, the binaural attributes of the output signals 915 are modified to produce audio signals from the physical speakers which are representative of those that would be produced if the audio signal were actually output from the desired location of the virtual source (i.e., at a certain offset from the physical speaker location).

As shown in FIG. 9, the modified output signals 915 are then provided to Crosstalk Cancellation Filter 920 to cancel the effects of crosstalk. The filter 920 may be similar to Crosstalk Filter With Modulating Delay 475 described above, except that the modulators 452 and 453 are removed, because the desired modulation has already been introduced by HRTF Binaural Synthesis System 910. After crosstalk cancellation, the resulting signals 401 and 402 may be sent to speakers 20 and 30. As described above, an optional stereophonic image enhancement system (such as 260 in FIG. 2) may be interposed between Crosstalk Cancellation Filter 920 and speakers 20 and 30.

While the present invention has been described and illustrated with reference to particular embodiments, it will be readily apparent to those skilled in the art that the scope of the present invention is not limited to the disclosed embodiments but, one the contrary, is intended to cover numerous other modifications and equivalent arrangements which are included within the spirit and scope of the following claims.

What is claimed is:

1. A method for producing an output audio signal perceived by a listener to originate from a virtual source, said method comprising the steps of:

receiving an audio signal to be output on a speaker system at a position offset from the location of the virtual source;

providing a spatial shift signal for modifying a spatial cue of the audio signal, wherein the spatial cue is selected from the group consisting of interaural time difference, interaural intensity difference and spectra;

using the spatial shift signal to modify the spatial cue of the audio signal to produce a localized value for the spatial cue, wherein the localized value for the spatial cue approximates a value for the spatial cue that would be produced if the audio signal were actually output from the location of the virtual source;

modulating the value of the spatial cue of the audio signal within a desired range around the localized value to enhance the ability of the listener to perceive the location of the virtual source; and outputting the modified and modulated audio signal from the speaker system.

2. The method of claim 1, wherein the step of modulating the value of the spatial cue further comprises the step of varying the spatial shift signal before using the spatial shift signal to modify the spatial cue of the audio signal.

3. The method of claim 1, wherein the step of modulating the value of the spatial cue further comprises the step of varying the audio signal after using the spatial shift signal to modify the spatial cue of the audio signal.

4. The method of claim 1, wherein the step of using the spatial shift signal to modify the spatial cue of the audio signal further comprises the step of producing at least two spatially shifted audio signals, the method further comprising the step of adding crosstalk compensation signals to each of the spatially shifted audio signals.

5. The method of claim 4, wherein each of the spatially shifted audio signals is an ipsilateral signal.

6. The method of claim 1, wherein the step of using the spatial shift signal to modify the spatial cue of the audio signal further comprises the step of producing at least two binaural pairs of audio signals, the method further comprising the step of generating crosstalk compensation signals for each of the binaural pairs of audio signals.

7. The method of claim 1, wherein the spatial cue comprises interaural time difference.

8. The method of claim 7, wherein modulating the value of the spatial cue of the audio signal within a desired range comprises modulating the interaural time difference between 0.09 milliseconds and 2.25 milliseconds around the localized value.

9. The method of claim 8, wherein the value of the interaural time difference is modulated at a rate between 0.5 and 1.5 Hz in the time domain.

10. The method of claim 8, wherein the value of the interaural time difference is modulated at a rate between 0.5 and 1.5 Hz in the frequency domain.

11. The method of claim 1, wherein the spatial cue comprises interaural intensity difference.

12. The method of claim 11, wherein modulating the value of the spatial cue of the audio signal within a desired range comprises modulating the interaural intensity difference between 0.25 decibels and 1.5 decibels around the localized value.

13. The method of claim 12, wherein the value of the interaural intensity difference is modulated at a rate between 0.5 and 1.5 Hz in the time domain.

14. The method of claim 12, wherein the value of the interaural intensity difference is modulated at a rate between 0.5 and 1.5 Hz in the frequency domain.

15. The method of claim 1, wherein the spatial cue comprises spectra.

16. A system for producing an output audio signal perceived by a listener to originate from a virtual source, the system comprising:

a processor operatively coupled to a memory;

the memory containing a spatial shift signal;

the processor receiving an input audio signal and modifying the input audio signal in accordance with the spatial shift signal to produce at least two spatially shifted signals that, in combination, possess the approximate localized value of spatial cues that would be produced if signals were actually output from the location of the virtual source;

a crosstalk compensation circuit;

the crosstalk compensation circuit generating at least one crosstalk compensation signal to compensate for crosstalk between the at least two spatially shifted signals;

a modulator for varying at least one spatial cue around the localized value for the at least two spatially shifted signals; and a speaker system for outputting the at least two spatially shifted signals with the varying spatial cue and the at least one crosstalk compensation signal.

17. The system of claim 16, wherein the modulator varies the spatial shift signal in order to vary the at least one spatial cue for the at least two spatially shifted signals.

18. The system of claim 16, wherein the modulator varies the crosstalk compensation signal in order to vary the at least one spatial cue for the at least two spatially shifted signals.

19. A method for producing an output audio signal perceived by a listener to originate from a virtual source, said method comprising the steps of:

receiving an audio signal to be output on a speaker system at a position offset from the location of the virtual source;

providing a spatial shift signal for modifying a spatial cue of the audio signal, wherein the spatial cue is selected from the group consisting of interaural time difference, interaural intensity difference and spectra;

using the spatial shift signal to modify the spatial cue of the audio signal to produce a localized value for the spatial cue, wherein the localized value for the spatial cue approximates a value for the spatial cue that would be produced if the audio signal were actually output from the location of the virtual source;

modulating the value of the spatial cue of the audio signal within a desired range around the localized value to enhance the ability of the listener to perceive the location of the virtual source, wherein the desired range within which the value of the spatial cue is modulated comprises a range below the just noticeable difference ("jnd") level of the spatial cue; and outputting the modified and modulated audio signal from the speaker system.

20. The method of claim 19, wherein the spatial cue comprises interaural time difference, modulating the value of the spatial cue of the audio signal within a desired range comprises modulating the interaural time difference between 0.09 milliseconds and 2.25 milliseconds around the localized value, and the value of the interaural time difference is modulated at a rate between 0.5 and 1.5 Hz in the time domain or the frequency domain.

21. The method of claim 19, wherein the spatial cue comprises interaural intensity difference, modulating the value of the spatial cue of the audio signal within a desired range comprises modulating the interaural intensity difference between 0.25 decibels and 1.5 decibels around the localized value, and the value of the interaural intensity difference is modulated at a rate between 0.5 and 1.5 Hz in the time domain or the frequency domain.

22. The method of claim 19, wherein the spatial cue comprises interaural time difference.

23. The method of claim 19, wherein the spatial cue comprises interaural intensity difference.

24. The method of claim 19, wherein the spatial cue comprises spectra.

* * * * *